United States Patent [19]

Björhn

[11] 4,116,436

[45] Sep. 26, 1978

[54] BALL-COLLECTING APPARATUS

[76] Inventor: Gunnar Björhn, Furusundsgatan 7, Stockholm, Sweden

[21] Appl. No.: 788,016

[22] Filed: Apr. 15, 1977

[30] Foreign Application Priority Data

Apr. 28, 1976 [SE] Sweden ..... 7604916

[51] Int. Cl.[2] ..... A63B 61/00

[52] U.S. Cl. ..... 273/29 R

[58] Field of Search ..... 273/29 R, 35 B, 35 A, 273/35 R, 176 E, 176 A, 176 F, 176 FA, 176 FB, 176 K, 182 R; 294/19 A

[56] References Cited

U.S. PATENT DOCUMENTS

| | | | |
|---|---|---|---|
| 3,203,696 | 8/1965 | Sawyer | 273/29 R |
| 4,004,806 | 1/1977 | Malik | 273/29 R |

*Primary Examiner*—Richard C. Pinkham
*Assistant Examiner*—T. Brown
*Attorney, Agent, or Firm*—Burns, Doane, Swecker and Mathis

[57] ABSTRACT

An apparatus for collecting tennis balls on a tennis court half comprising two ribs, one rib of which normally is located along each of two opposite edges of the court half. Drive means are arranged to displace the ribs toward each other while conveying balls on the court surface, thereby to collect the balls in a limited area, and then to return the ribs to their normal position. Control means are arranged to control the drive means. The control means are preferably actuatable by the player and suitably from a position located within the limited ball-collecting area. Preferably at least one of the ribs is arranged to be angled or curved in the horizontal plane, such that the concave side of the rib faces the other rib and suitably the ribs are brought to cross each other in order to diminish the ball-collecting area also perpendicularly to the displacement direction of the ribs.

7 Claims, 5 Drawing Figures

BALL-COLLECTING APPARATUS

Figure 1:
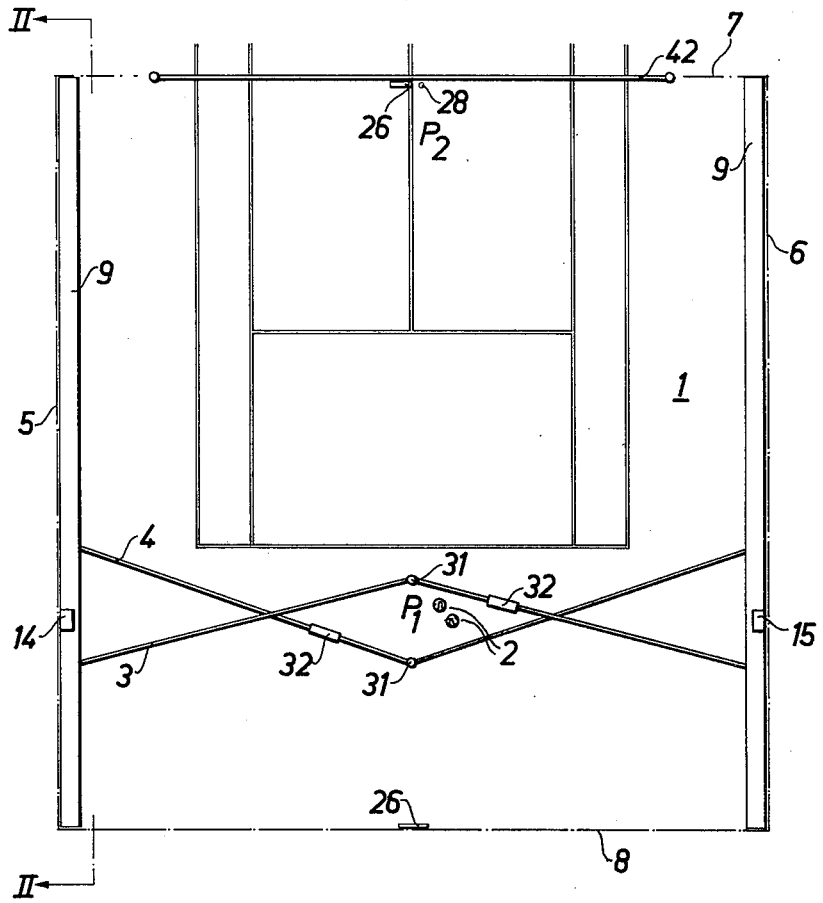

The present invention refers to an apparatus for collecting balls on a tennis court half.

When playing tennis the tennis players normally rent the court per hour. A major part of the playing time is consumed by gathering of tennis balls. Hereby the players cannot efficiently utilize the booked time. One object with the present invention is therefore to provide a ball collecting apparatus at a tennis court half, which apparatus has a simple structure, can be simply controlled and permits a better utilization of the booked playtime for play or for training and practicing chosen practice items.

The inventive apparatus is characterized in that two ribs, which each extend close to the court surface between two opposite side edges of the court half, are normally located along each of the two other side edges of the court half, in that drive means are arranged and adapted to displace the ribs towards each other while conveying balls whereby these are collected in a limited area on the court half, in that at least one control means is arranged actuatable from a position on the court half, said control means being arranged to control said drive means, in that means are arranged to maintain both ends of the ribs in connection to the respective adjacent side edges of the court half during the displacement of the ribs, and in that the ball collecting area is located around the control position.

A tennis court half has normally a surface area of around 350 square meters and at practice play the players use some 10 balls. It is appreciated that a ball collecting apparatus of the inventive type by actuation can reduce the surface area within which the balls are present, e.g. to 1/20 of the surface area of the court half. This means in turn a substantially corresponding time gain relative to the time lapse that otherwise occurs for the ball collecting item.

The inventive apparatus thus makes the play significantly more efficient and this means that the players now can make maybe 50 percent more hits than before during the same time period. This also of course means that the court can be more efficiently utilized whereby the booking periods may be shorten from for example one hour to three quarters of an hour which in turn may mean raised rent income for the court owner.

Preferably the ribs extend between those side edges of the court half which are parallel with the main play-direction, and then one of the ribs normally is located along the rear limitation of the rear plane of the tennis court half, usually a safe net, while the other rib normally is located along the net of the tennis court. Preferably the ribs are arranged across each other at their ball collecting movement. Suitably at least one of the ribs is arranged and adapted to be curved or angled in the horizontal plane by displacement from the normal position such that the concavity of the rib faces the other rib. In order to provide such an angle formation, said rib may comprise at least one knee-joint and at least one coupling of the type which permits a limited axial relative movement between two adjacent longitudinal sections of the rib. Alternatively in order to bring one or both ribs into a curved shape, it is possible to let the rib or the ribs in unloaded condition have a curved shape and furthermore be relatively easy bendable, and moreover the rib should comprise a coupling of the type mentioned above. In order to be able to locate the ribs in their normal position close to and along the border edges of the court, it is suitable to arrange abutments for each of the ribs at said border edges such that the ribs are straightened when the drive means drive the ends of the ribs toward normal position.

In the following exemplary embodiments of the invention will be closer described with reference to the accompanying drawings.

FIG. 1 schematically illustrates a tennis court half at which the inventive apparatus is mounted.

Figure 2:
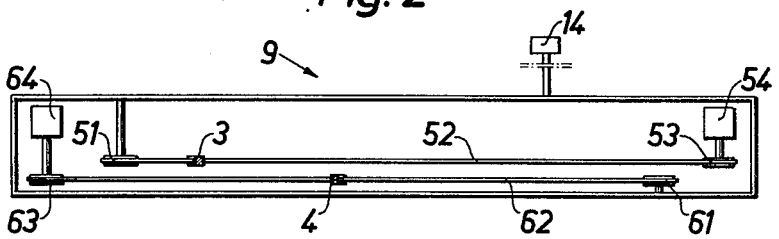

FIG. 2 schematically illustrates a view taken along line 2—2 in FIG. 1.

Figure 3:
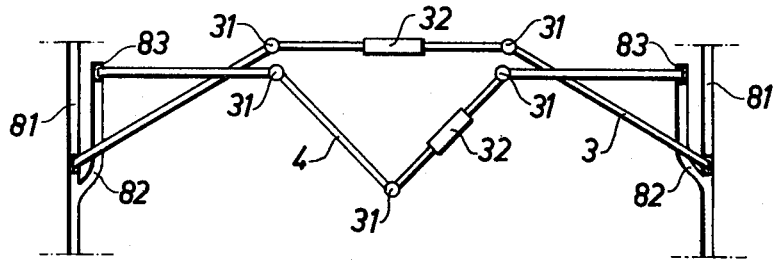

FIG. 3 illustrates an alternative embodiment of the ribs in an apparatus according the invention.

Figure 4:
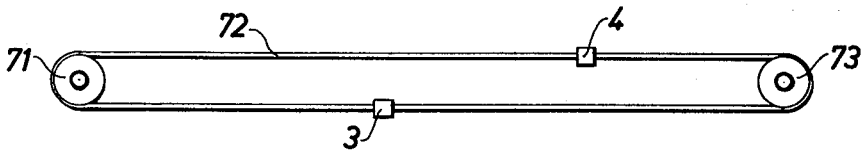

FIG. 4 schematically illustrates a possible embodiment of the drive means of the ribs.

Figure 5:
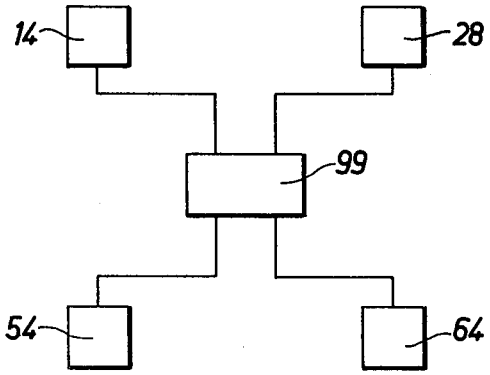

FIG. 5 schematically illustrates how control means may be arranged to control the drive means.

In FIG. 1 there is illustrated a tennis court half which generally is designated by 1. Within the edges or boundary lines 5,6,7,8 of the tennis court half there are illustrated by full-lines those border lines which refer to the play-surface of the tennis court half.

Along the longitudinal edges 5,6 of the court half 1 there is drive and control apparatus 9 for two ball collecting ribs 3 and 4 respectively.

From a position $P_1$ and $P_2$ respectively on the court half 1 the player can actuate a control means 14, 15 and 28 respectively. The control means 14, 15 may comprise a light source and a photo cell. The light source 14 and the photo cell 15 can be located on let us say a height of 2.5 m above the court surface and be situated behind the base line of the play surface. In order to actuate the control means 14, 15 the player can then if he stands in the position $P_1$ brake the light beam by means of his racket.

Alternatively the player can if he stands in the position $P_2$ actuate the control means 28, which may be constituted by a switch that is situated under the net 42 of the tennis court.

As is evident from FIG. 2, the end of rib 3 may be connected to an endless chain 52 which runs around two rotatably journalled pulleys 51 and 53 resp. The pulley 53 may be connected to the drive motor 54. The end of rib 4 is in a corresponding way connected to an endless chain 62 which is arranged around two pulleys 61 and 63 resp, and the pulley 63 is drivable by means of a motor 64.

In its normal position the rib 3 is in straightened condition, located along the forward limitation line 7 of the court half, in which condition the intermediate portion of the rib 3 engages an abutment 26.

Correspondingly the rib 4 is in its normal position, in straightened condition, located along the rear boundary line 8 of the rear plane, and there the intermediate portion of the rib 4 engages a corresponding abutment 26.

Now if the player wishes to collect the balls, for example for training of the serves, he moves to the position $P_1$ just behind the base line of the play-surface. Now he raises his racket and brakes the light beam between the light source 14 and the photo cell 15. The photo cell 15 controls the motors 54 and 64 resp. in such a way that the ribs 3 and 4 are moved toward each other while bringing along those balls which are present on the tennis court half 1.

In order to minimize the ball collecting area the ribs 3 and 4 are brought to cross each other.

The rib 3 has a pivot joint 31 and a coupling 32 of the time which permits a limited axial relative movement between those two parts of the ribs which are connected by means of the coupling 32. The coupling 32 can in one embodiment consist of a slot in one of the rib-parts which slot is parallel with said rib-part, and two closely arranged bolts on the adjacent rib-part, which bolts extend through the slot.

Correspondingly the rib 4 comprises a joint 31 and coupling 32.

If the player stands in the position $P_2$ and actuates the switch 28, the drive apparatus 9 can be programmed such that the rib 4 moves substantially all the way from the rear boundary line 8 to the forward boundary line 7, while the forward rib 3 merely is driven in such a way that it is pivoted around the joint 31.

In FIG. 3 another embodiment of ribs 3, 4 and their endguides is illustrated. In this case the rib 3 has two joints 31 and one coupling 32 while the rib 4 comprises three joints 31 and at least one coupling 32. The ends of ribs 3 are guided in each one track 81. The tracks 81 have each one "blind track" 82 into which the ends of the rib 4 are guided at the ball collecting area defined by the space surrounded by the ribs 3,4. With reference to FIG. 1 it is quite possible to partly replace the apparatus 9 by a track 81 and an associated blind track 82 at each of the positions $P_1$ and $P_2$ respectively. In FIG. 3 we have not illustrated the drive apparatus which may be of any of a number of different designs. The ends of rib 4 according to FIG. 3 should be provided with guide shoes 83 which maintain a predetermined angle between the guide track 81,82 and the end of the rib.

In FIG. 4 there is illustrated a simplified drive apparatus of the same type as apparatus 9 according to FIG. 2. In this case the rib 4 is connected to the upper run of an endless chain 72, while the rib 3 is connected to the lower run of chain 72. Chain 72 runs around two pulleys 71 and 73 respectively of which one pulley may be provided with a drive motor which is actuatable by a control means which in this case should be situated near or at the half length of the court half.

It is appreciated that in this case in the normal position, the ends of the ribs 3, 4, are located at each one of the turning points of the chain 72 and that the rib-ends may be brought to cross each other if the chain 72 is driven somewhat more than one fourth of its length from the normal position.

FIG. 5 illustrates merely schematically how one or the other of the control means 14, 15 or 28 can actuate a program apparatus 99 which controls the drive motors 54 and 64 respectively (at the mechanism according to FIG. 2). The program apparatus 99 is suitably arranged to control the motors 54 and 64 in such a way that they after having brought the ribs 3, 4 to collect the balls around the position $P_1$ och $P_2$ immediately return the ribs 3, 4 to their normal positions. The above described embodiments merely aims to exemplify the invention and should not be interpreted in any limiting sense.

Further, it should be clear that the control/drive means 9 should have as small dimension as possible and suitably have a sloping roof such that balls can roll down onto the play-surface.

The drive apparatus according to FIG. 4 are suitable to place along the forward limitation 7 and rearward limitation 8 of the play-surface, such that the ribs 3, 4 extend substantially in the play-direction. In this case the curve or angle of the ribs should be located at a place corresponding to position P in FIG. 1.

As an alternative embodiment, the control means 14, 15 and 28 respectively can be exchanged for a portable transmitter, either a radio or sound transmitter which actuates a receiver which in turn controls the rib drive means. In this case, the transmitter may comprise two buttons, one for each of the abovementioned ball collecting areas.

The player can carry the remote control transmitter in his pocket.

What is claimed is:

1. An apparatus useful for collecting tennis balls on a tennis court half comprising two ribs, each rib extending close to the court surface between two opposite side edges of the court half (1), one rib normally being located along each one of the two other side edges of the court half;

drive means (51–54; 61–64; 71–73) arranged to displace the ribs (3,4) towards each other while conveying balls such that these are collected in a limited area, and to displace the ribs into their normal positions, at least one contrl means (14,15; 28) arranged actuatable from a position ($P_1$; $P_2$) on the court half, said control means being arranged to control the drive means, and said control position being located in the ball collecting area, and means arranged to maintain both ends of the ribs close to respective adjacent side edges of the court half during displacement of the ribs.

2. An apparatus according to claim 1 wherein the ribs extend between those side edges of the court half which are parallel with the play direction, one of the ribs normally being located along the rear limitation of the rear plane of the court half (1), the other rib normally being located along the net of the tennis court.

3. An apparatus according to claim 1 wherein the ribs are arranged to cross each other during ball collecting movement.

4. An apparatus according to claim 3 wherein at least one of the ribs is concaved in the horizontal plane upon displacement from the normal position thereof, such that the concavity of the rib faces the other rib.

5. An apparatus according to claim 3 wherein at least one of the ribs (3,4) has at least two parts and comprises at least one pivot joint (31) and at least one coupling (32) joining said two parts, said coupling being of the type permitting limited axial movement between said two parts of the rib.

6. An apparatus according to claim 3 wherein at least one of the ribs is flexible and while in ball collecting operation said ribs has a curved shape, and wherein said rib has at least two parts and comprises at least one coupling (32) joining said two parts, said coupling being of the type permitting limited axial movement between said two parts of the rib.

7. An apparatus according to claim 4 wherein said at least one rib during movement towards its normal position will be brought into contact with an abutment (26) such that it is straightened when the drive means drives the ends thereof towards said normal position.

* * * * *